US007344601B2

(12) United States Patent
Coye et al.

(10) Patent No.: US 7,344,601 B2
(45) Date of Patent: Mar. 18, 2008

(54) INTEGRATED CROSS-WIRE FIXTURE FOR COATING A DEVICE, A METHOD OF USING THE FIXTURE, AND A DEVICE MADE USING THE FIXTURE

(75) Inventors: Colga Coye, Athenry (IE); Noel Boyhan, Castlepollard (IE)

(73) Assignee: Boston Scientific Scimed, Inc., Maple Grove, MN (US)

( * ) Notice: Subject to any disclaimer, the term of this patent is extended or adjusted under 35 U.S.C. 154(b) by 0 days.

(21) Appl. No.: 11/030,406

(22) Filed: Jan. 5, 2005

(65) Prior Publication Data

US 2006/0147611 A1 Jul. 6, 2006

(51) Int. Cl.
*B05C 13/02* (2006.01)

(52) U.S. Cl. ..... 118/500; 427/2.1

(58) Field of Classification Search ..... 118/500; 427/2.1, 2.24; 623/1.1, 1.46, 1.47, 1.48; 132/321–325, 328, 329
See application file for complete search history.

(56) References Cited

U.S. PATENT DOCUMENTS 1,229,428 A * 6/1917 Fabritius ..... 118/503
2,197,345 A * 4/1940 Meyer ..... 132/325
2,873,749 A * 2/1959 Borgtor ..... 132/323
3,226,245 A * 12/1965 Dettling et al. ..... 427/185
4,655,771 A 4/1987 Wallsten
4,954,126 A 9/1990 Wallsten
5,782,250 A * 7/1998 Harrah, Jr. ..... 132/327
5,824,049 A 10/1998 Ragheb et al.
6,096,070 A 8/2000 Ragheb et al.
6,986,735 B2 * 1/2006 Abraham et al. ..... 600/36
2002/0017998 A1 * 2/2002 Price ..... 340/573.1
2004/0013792 A1 1/2004 Epstein et al.

FOREIGN PATENT DOCUMENTS

WO WO 03/045456 * 6/2003

* cited by examiner

*Primary Examiner*—George Koch
(74) *Attorney, Agent, or Firm*—Kenyon & Kenyon LLP

(57) ABSTRACT

A fixture is provided for holding a hollow, cylindrical device from an inside surface that includes a plastic collar component and a main frame fixture insert molded into the plastic collar component. The fixture may include a cross-wire adapted to: loop over a section of the main frame fixture; traverse a space between the main frame fixture and the plastic collar component; and loop over a section of the plastic collar component. An apparatus is provided for holding a cylindrical device having an open interior and at least one open end. The apparatus includes an engagement arrangement including at least two activatable projections on a distal end and a base attached to a proximal end of the engagement arrangement. The projections move radially when activated.

20 Claims, 4 Drawing Sheets

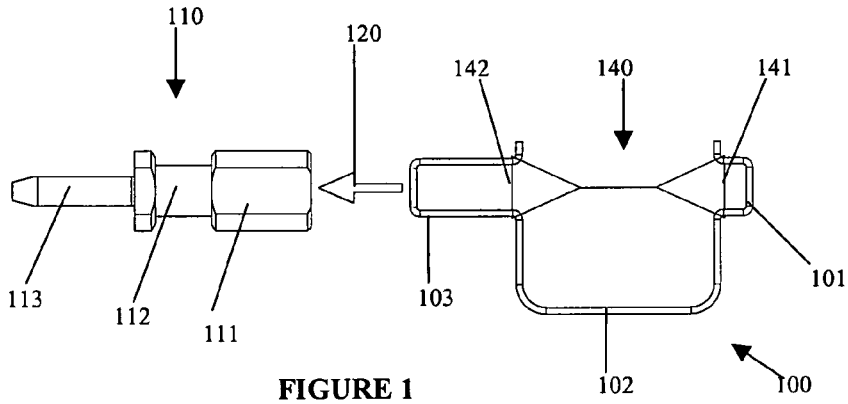
FIGURE 1
(PRIOR ART)
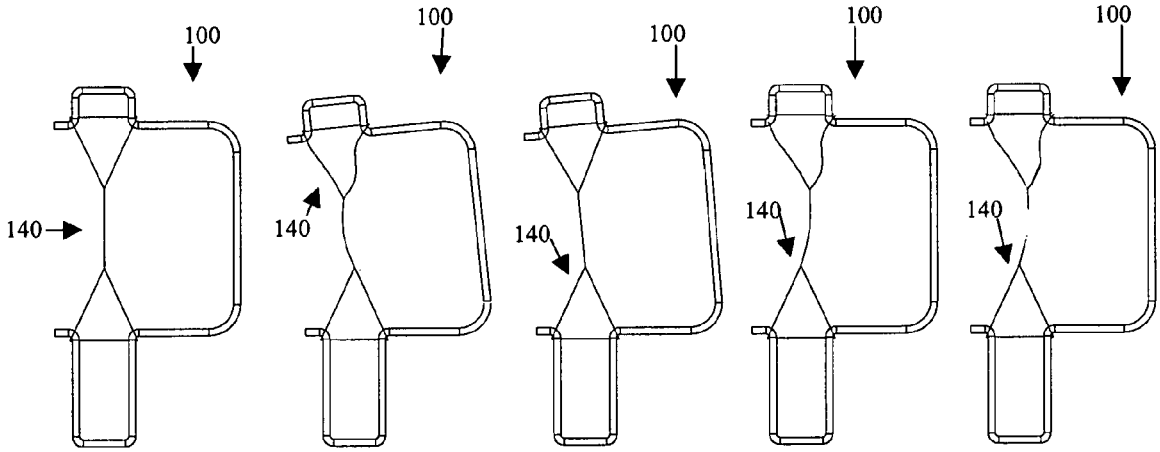
FIGURE 2.1
(PRIOR ART)
FIGURE 2.2
(PRIOR ART
FIGURE 2.3
(PRIOR ART)
FIGURE 2.4
(PRIOR ART)
FIGURE 2.5
(PRIOR ART)

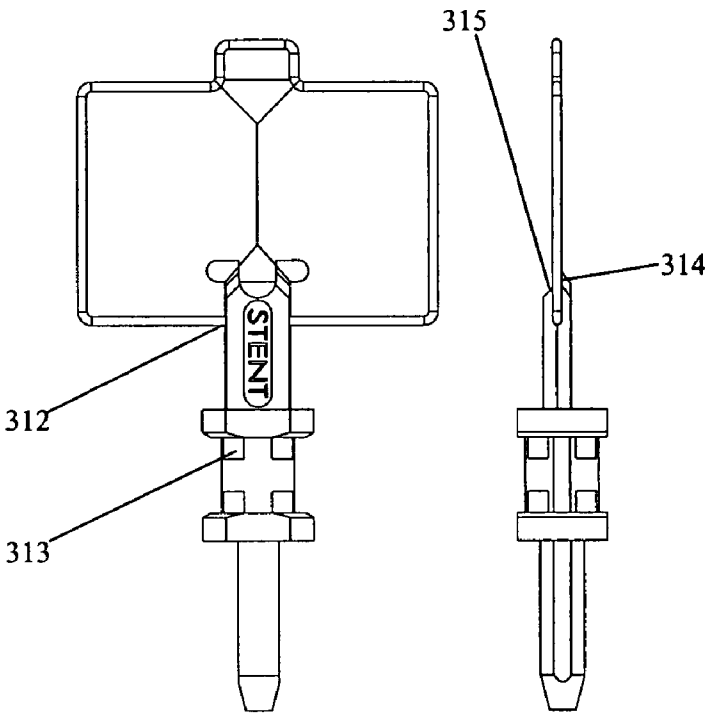
FIGURE 4.1 FIGURE 4.2
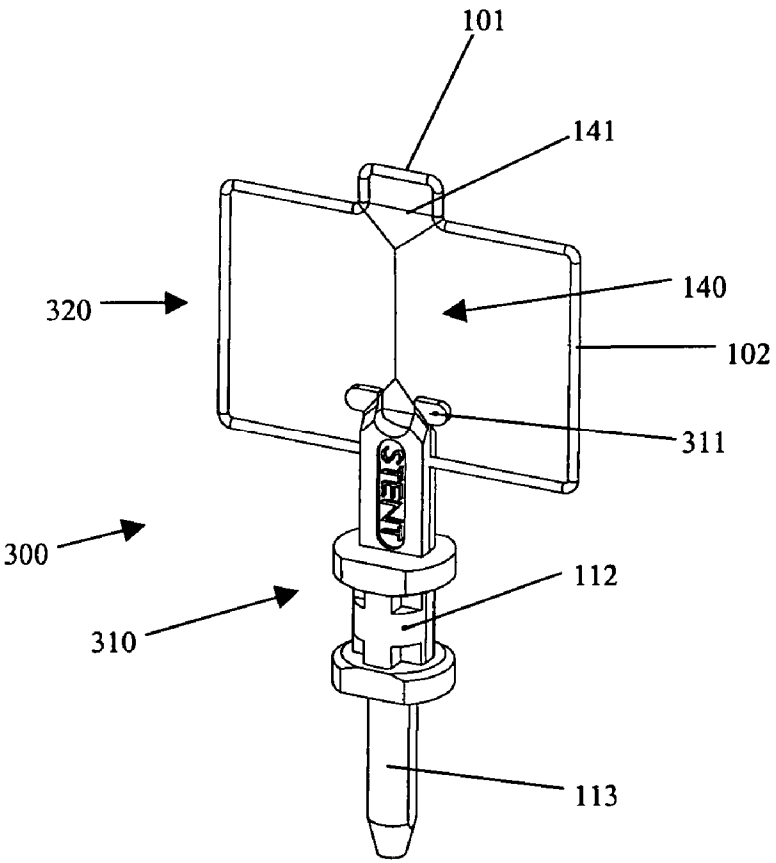
FIGURE 3

INTEGRATED CROSS-WIRE FIXTURE FOR COATING A DEVICE, A METHOD OF USING THE FIXTURE, AND A DEVICE MADE USING THE FIXTURE

FIELD OF THE INVENTION

The present invention relates to coating devices. More particularly, the present invention relates to an integrated cross-wire fixture for holding a stent or other device during a coating or other process.

BACKGROUND INFORMATION

Medical devices may be coated so that the surfaces of such devices have desired properties or effects. For example, it may be useful to coat medical devices to provide for the localized delivery of therapeutic agents to target locations within the body, such as to treat localized disease (e.g., heart disease) or occluded body lumens. Localized drug delivery may avoid some of the problems of systemic drug administration, which may be accompanied by unwanted effects on parts of the body which are not to be treated. Additionally, treatment of the afflicted part of the body may require a high concentration of therapeutic agent that may not be achievable by systemic administration. Localized drug delivery may be achieved, for example, by coating balloon catheters, stents and the like with the therapeutic agent to be locally delivered. The coating on medical devices may provide for controlled release, which may include long-term or sustained release, of a bioactive material.

Aside from facilitating localized drug delivery, medical devices may be coated with materials to provide beneficial surface properties. For example, medical devices are often coated with radiopaque materials to allow for fluoroscopic visualization while placed in the body. It is also useful to coat certain devices to achieve enhanced biocompatibility and to improve surface properties such as lubriciousness.

Coatings have been applied to medical devices by processes such as dipping, spraying, vapor deposition, plasma polymerization, spin-coating and electrodeposition. Although these processes have been used to produce satisfactory coatings, they have numerous, associated potential drawbacks. For example, it may be difficult to achieve coatings of uniform thicknesses, both on individual parts and on batches of parts. Further, many conventional processes require multiple coating steps or stages for the application of a second coating material, or may require drying between coating steps or after the final coating step.

The spray-coating method has been used because of its excellent features, e.g., good efficiency and control over the amount or thickness of coating. However, conventional spray-coating methods, which may be implemented with a device such as an airbrush, have drawbacks. For example, when a medical device has a structure such that a portion of the device obstructs sprayed droplets from reaching another portion of the device, then the coating becomes uneven. Specifically, when a spray-coating is employed to coat a stent having a tube-like structure with openings, such as stents described in U.S. Pat. Nos. 4,655,771 and 4,954,126 to Wallsten, the coating on the inner wall of the tube-like structure may tend to be thinner than that applied to the outer wall of the tube-like structure. Hence, conventional spraying methods may tend to produce coated stents with coatings that are not uniform. Furthermore, conventional spraying methods are inefficient. In particular, generally only 5% of the coating solution that is sprayed to coat the medical device is actually deposited on the surface of the medical device. The majority of the sprayed coating solution may therefore be wasted.

In addition to the spray coating and spin-dipping methods, the electrostatic deposition method has been suggested for coating medical devices. For example, U.S. Pat. Nos. 5,824,049 and 6,096,070 to Ragheb et al. mention the use of electrostatic deposition to coat a medical device with a bioactive material. In the conventional electrodeposition or electrostatic spraying method, a surface of the medical device is electrically grounded and a gas may be used to atomize the coating solution into droplets. The droplets are then electrically charged using, for example, corona discharge, i.e., the atomized droplets are electrically charged by passing through a corona field. Since the droplets are charged, when they are applied to the surface of the medical device, they will be attracted to the surface since it is grounded.

Conventionally, stents are coated using a nozzle to apply a solution containing a polymer and drug. The stent is held as it is moved in front of the spray nozzle by a fixture called a cross-wire that is comprised of fine wires which make contact with the stent struts.

Loading a stent on a conventional cross-wire fixture may be a complicated process, and there are various opportunities for errors in the loading process. The process steps for loading a stent on a conventional cross-wire fixture may include: loading a stent onto a cross-wire fixture; loading the cross-wire fixture with the stent into a multi-sprayer collar; and placing the assembly in a vertical alignment system and aligning it.

The existing means of mounting conventional stents for a spray coating process may include two tooling parts, namely an assembly cross-wire fixture and a production collar (also referred to as a multi-sprayer collet). This process involves a sensitive assembly and handling process. The nature of the design of the cross-wire fixture assembly means that the fixture may be strained beyond its elastic limit or the wire strained or broken during stent loading.

FIG. 1 shows conventional cross-wire fixture 100 and conventional collet 110. Conventional cross-wire fixture 100 includes end loop C frame 101, long C frame 102, and collet fixture C frame 103. Looped over end loop C frame 101 and collet fixture C frame 103 is cross-wire 140, which includes end loop of cross-wire 141 and collet-side loop of cross-wire 142. Specifically end loop of cross-wire 141 loops over end loop C frame 101, while collet-side loop of cross-wire 142 loops over collet fixture C frame 103. The central section of cross-wire 140 extends between end loop C frame 101 and collet fixture C frame 103 and is taut.

Conventional collet 110 of FIG. 1 includes frame fixture fitting 111, pick and place interface 112, and stem shaft 113. During the fixturing process, after the stent is placed on cross-wire 140, conventional cross-wire fixture 100 is inserted in conventional collet 110 by moving it in the direction of arrow 120.

FIG. 2.1 illustrates conventional cross-wire fixture 100 with cross-wire 140 correctly installed. FIGS. 2.2 to 2.5 depict some of the potential problems associated with conventional cross-wire fixture 100. Some inadequacies shown relate to the relationship between conventional cross-wire fixture 100 and cross-wire 140. FIG. 2.2 illustrates that, during installation, the fixture may be strained beyond its elastic limit. This results in a bent C frame, possibly causing the wire to be slack. Alternatively, the wire may be short, making it difficult to align the loaded stent, as shown in FIG. 2.3. The wire may be too long, making it difficult to tension and align the loaded stent, as shown in FIG. 2.4. The wire may be broken by the operator while manipulating the assembly, as shown in FIG. 2.5.

Another problem arises from the requirement that the fixture be fitted to the collar each time a new stent (or other medical device) is installed on the cross-wire. The fixture to collar fit may be incorrect due to the open-ended design of the fixture. The fixture may be installed in an incorrect orientation with respect to the collar, may not be installed completely in the collar slot, and/or may be bent or otherwise damaged during the installation in the collar. Additionally, the collar slot may become fouled or otherwise blocked or damaged causing the fixture to become unusable.

A stent or other device that is fixtured on a cross-wire frame may undergo various processes while fixtured, including pre-weighing, aligning, spraying, drying (by heating, blowing and/or a vacuum), post-weighing, and final inspection.

An insert molding process allows the integration of a metal (or other material) device with a plastic, polyurethane, or other injection molded material. The metal (or similar material) device may be precisely aligned with the mold of the injection molded material to create a uniform product. This process is used to make screwdrivers, phasetesters, and similar objects.

There is, therefore, a need for a simple, cost-effective device for fixturing a medical appliance or other device that facilitates coating of the devices. Each of the references cited herein is incorporated by reference herein for background information.

SUMMARY

A fixture is provided for holding a hollow, cylindrical device from an inside surface that includes a plastic collar component and a main frame fixture insert molded into the plastic collar component. The fixture includes a cross-wire adapted to: loop over a section of the main frame fixture; traverse a space between the main frame fixture and the plastic collar component; and loop over a section of the plastic collar component.

In the fixture, the section of the plastic collar component may include two tabs. In the fixture, the plastic collar component may be adapted to visually indicate an incorrectly looped cross-wire. The plastic collar component may be adapted to accommodate a correctly looped cross-wire in a groove of the plastic collar component or parallel to a feature of the plastic collar component. The plastic collar component may be adapted to accommodate the incorrectly looped cross-wire across a groove of the plastic collar component or across a feature of the plastic collar component.

The fixture may include a trigger-activated tensioner adapted to tension the cross-wire on the main frame fixture.

In the fixture, the main frame fixture may include a symmetric design. The symmetric design may include two oval halves. The symmetric design may include two rectangular halves.

In the fixture, the plastic collar component may include a pick-and-place interface and a stem shaft. The pick-and-place interface may include a molding sink relief adapted to be manipulated by a robotic arm.

In the fixture, the fixture may be adapted to hold a stent during a coating operation.

An apparatus is provided for holding a cylindrical device having an open interior and at least one open end. The apparatus includes an engagement arrangement including at least two activatable projections on a distal end and a base attached to a proximal end of the engagement arrangement. The projections move radially when activated.

The apparatus may be adapted to hold a stent during a coating operation.

The projections may be releasable and may move axially when released. When the projections are released, the cylindrical device may slide freely over the projections. The apparatus may include a trigger coupled to the base and adapted to release the projections.

The engagement arrangement may be spring-loaded to activate the projections.

BRIEF DESCRIPTION OF THE DRAWINGS

FIG. 1 shows a conventional cross-wire fixture, a cross-wire, and a collet.

FIG. 2.1 shows a conventional cross-wire fixture with a cross-wire in a normal condition.

FIGS. 2.2 to 2.5 show conventional cross-wire fixtures with cross-wires in a variety of abnormal conditions.

FIG. 3 shows an integrated cross-wire fixture according to an exemplary embodiment of the present invention.

FIGS. 4.1 and 4.2 show two additional views of the integrated cross-wire fixture shown in FIG. 3.

FIGS. 6.1 and 6.2 show an integrated cross-wire fixture according to another alternative exemplary embodiment of the present invention, with and without a stent.

DETAILED DESCRIPTION

Figures 5, 7:
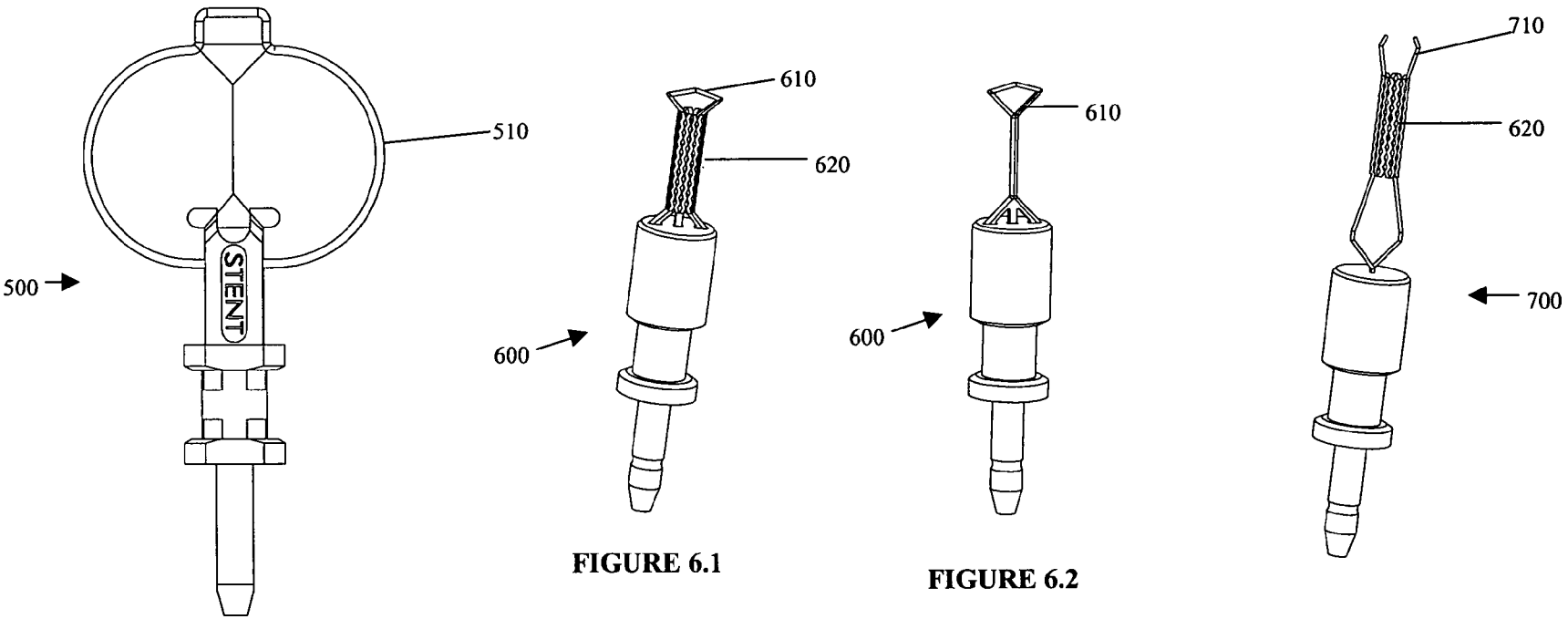
FIG. 5 shows an integrated cross-wire fixture according to an alternative exemplary embodiment of the present invention.
FIG. 7 shows an integrated cross-wire fixture according to another alternative exemplary embodiment of the present invention.

The integrated cross-wire fixture is a device which combines two separate assembly components into one. In particular, the integrated cross-wire fixture combines the multi-sprayer collet/collar and the cross-wire fixture, used in the mounting of the stents during the drug coating/spraying process, into one integrated component. Both the multi-sprayer collar and the cross-wire fixture are completely re-designed to suit an insert molding manufacturing process. In combining versions of two existing tooling components, the design combines three currently complex production process steps into two simpler steps.

The new process includes: loading a stent onto the integrated cross-wire fixture; and placing the integrated cross-wire fixture into a vertical alignment system and aligning.

FIG. 3 shows integrated cross-wire fixture 300. Integrated cross-wire fixture 300 comprises a bent stainless steel wire component (fixture main frame 320) insert molded into a plastic housing (insert molded collet section 310). The cross-wire element (cross-wire 140) may also be already assembled or may be fitted during stent mounting.

The insert molding manufacturing process makes the entire assembly more dimensionally consistent and repeatable. There is reduced assembly and complexity compared to the existing process. The design of cross-wire anchors 311 for the lower cross-wire allows flexibility in its design, as it is integrally molded as part of the overall housing. FIG. 4.1 shows how cross-wire anchors 311 are keyed to facilitate correct installation of cross-wire 140. Backwards installation of cross-wire 140, which is a frequent problem in the conventional process resulting in eccentric mounting of the entire stent, is thereby avoided.

FIG. 4.2 shows the asymmetric design of central axis side of loop anchor 314 and loop crossing side of loop anchor 315. Symmetric design of fixture main frame 320 maintains concentricity between cross-wire 140 and the central axis of integrated cross-wire fixture 300. This feature also makes the wire fixture element (fixture main frame 320) self centering and reduces the chance of misalignment due to process handling, which is apparent in figure 4.2.

The insert molding process is simplified from that of conventional production collars. The proposed collar element has no requirement for a cored inner (also referred to herein as a collar slot) to accommodate installation of a cross-wire fixture, because fixture main frame 320 is insert molded as part of the manufacture. The design of integrated cross-wire fixture 300 allows for more flexibility in the overall shape of the insert molded collet section 310 allowing for integration of such features as 2D matrix coding, radio frequency identification (RFID) tagging, laser etching, and other identification and process control devices and systems. The design of insert molded collet section 310 accommodates the existing process stent coating process while conforming to a design which is suitable for injection molding.

FIG. 4.2 shows integrated cross-wire fixture 300 in a side view. The stent mounting element (fixture main frame 320) is mounted eccentrically so that cross-wire 140, and therefore the stent, locates coaxially onto the overall collar.

There are several alternative designs that utilize some or all of the features of the integrated cross-wire fixture. Alternative shapes of bent wire fixture (in side profile), such as a curved rather than a square frame are also possible. FIG. 5 shows curved main frame fixture 510 in curved integrated cross-wire fixture 500. Additionally, alternative shapes for a main frame fixture, including asymmetric shapes, may also be possible.

One-piece, all plastic injection molded production collars and stent mounting fixtures are also possible. One such design is shown in FIGS. 6.1 and 6.2. Diamond assembly integrated fixture 600 is shown holding stent 620 in FIG. 6.1. Diamond frame 610 may be retracted radially inward either manually or with a trigger or button. In a retracted state, stent 620 may be inserted over diamond frame 610. Subsequently, either by releasing diamond frame 610, applying an opening force manually to diamond frame 610, or by releasing the trigger or button, diamond frame 610 may be returned to its extended position, as shown in FIGS. 6.1 and 6.2. As shown in FIG. 6.1, diamond frame 610 in the extended position may hold stent 620 from the inside.

FIG. 7 shows another alternative design. Integrated tuning fork fixture 700 includes bent tuning fork-type wire arrangement 710 that is insert molded into a plastic production collar element. FIG. 7 shows bent tuning fork-type wire arrangement 710 holding stent 620 with an outward force on bent tuning fork-type wire arrangement 710. The two tines of bent tuning fork-type wire arrangement 710 may be closed into an axial position either manually or by a trigger or button in order to install or remove a stent from integrated tuning fork fixture 700.

There are several alternative materials and/or coatings that may be utilized in the integrated cross-wire fixture. Stainless steel wire of various material content depending on the mechanical characteristics required. Fixture may be made from Nitinol wire with shape memory characteristics for stent mounting purposes. Plastics may be selected for use based on flexibility, stiffness, and/or shape memory characteristics.

There are several alternative applications utilizing the integrated cross-wire fixture. The integrated cross-wire fixture may be used in spray coating, of bioactive agents or surface coatings, or any other processing step requiring access to the external surface of a stent or other medical device or implant.

Figure 8:
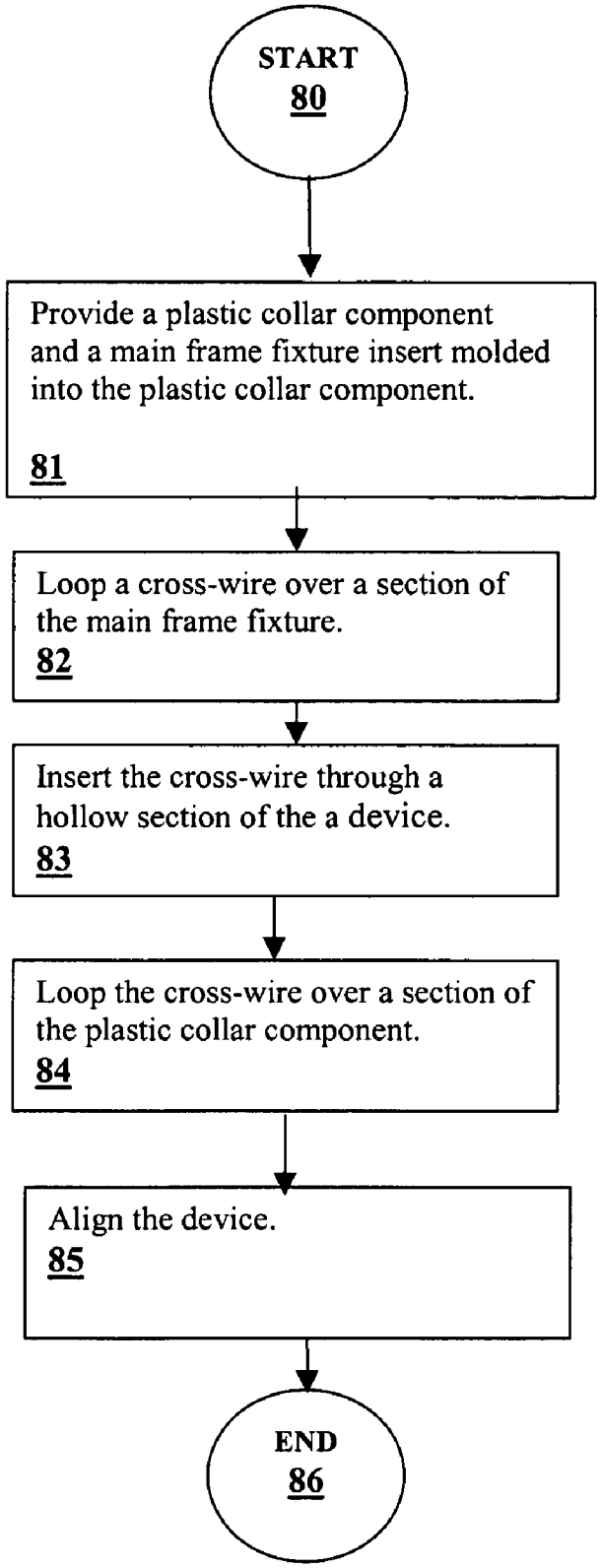
FIG. 8 shows a flowchart for performing an exemplary method of the present invention.

FIG. 8 shows a flowchart for performing an exemplary method of the present invention. The flow in FIG. 8 starts in start circle 80 and flows to action 81, which indicates to provide a plastic collar component and a main frame fixture insert molded into the plastic collar component. From action 81, the flow proceeds to action 82, which indicates to loop a cross-wire over a section of the main frame fixture. From action 82, the flow proceeds to action 83, which indicates to insert the cross-wire through a hollow section of the device. From action 83, the flow proceeds to action 84, which indicates to loop the cross-wire over a section of the plastic collar component. From action 84, the flow proceeds to action 85, which indicates to align the device. From action 85, the flow proceeds to end circle 86.

As used herein, the term "therapeutic agent" includes one or more "therapeutic agents" or "drugs". The terms "therapeutic agents", "active substance" and "drugs" are used interchangeably herein and include pharmaceutically active compounds, nucleic acids with and without carrier vectors such as lipids, compacting agents (such as histones), virus (such as adenovirus, adenoassociated virus, retrovirus, lentivirus and α-virus), polymers, hyaluronic acid, proteins, cells and the like, with or without targeting sequences.

The therapeutic agent may be any pharmaceutically acceptable agent such as a non-genetic therapeutic agent, a biomolecule, a small molecule, or cells.

Exemplary non-genetic therapeutic agents include anti-thrombogenic agents such heparin, heparin derivatives, prostaglandin (including micellar prostaglandin E1), urokinase, and PPack (dextrophenylalanine proline arginine chloromethylketone); anti-proliferative agents such as enoxaprin, angiopeptin, sirolimus (rapamycin), tacrolimus, everolimus, monoclonal antibodies capable of blocking smooth muscle cell proliferation, hirudin, and acetylsalicylic acid; anti-inflammatory agents such as dexamethasone, rosiglitazone, prednisolone, corticosterone, budesonide, estrogen, estrodiol, sulfasalazine, acetylsalicylic acid, mycophenolic acid, and mesalamine; anti-neoplastic/anti-proliferative/anti-mitotic agents such as paclitaxel, epothilone, cladribine, 5-fluorouracil, methotrexate, doxorubicin, daunorubicin, cyclosporine, cisplatin, vinblastine, vincristine, epothilones, endostatin, trapidil, halofuginone, and angiostatin; anti-cancer agents such as antisense inhibitors of c-myc oncogene; anti-microbial agents such as triclosan, cephalosporins, aminoglycosides, nitrofurantoin, silver ions, compounds, or salts; bioflim synthesis inhibitors such as non-steroidal anti-inflammatory agents and chelating agents such as ethylenediaminetetraacetic acid, O,O'-bis (2-aminoethyl)ethyleneglycol-N,N,N',N'-tetraacetic acid and mixtures thereof; antibiotics such as gentamycin, rifampin, minocyclin, and ciprofolxacin; antibodies including chimeric antibodies and antibody fragments; anesthetic agents such as lidocaine, bupivacaine, and ropivacaine; nitric oxide; nitric oxide (NO) donors such as linsidomine, molsidomine, L-arginine, NO-carbohydrate adducts, polymeric or oligomeric NO adducts; anti-coagulants such as D-Phe-Pro-Arg chloromethyl ketone, an RGD peptide-containing compound, heparin, antithrombin compounds, platelet receptor antagonists, anti-thrombin antibodies, anti-platelet receptor antibodies, enoxaparin, hirudin, warfarin sodium, Dicumarol, aspirin, prostaglandin inhibitors, platelet aggregation inhibitors such as cilostazol and tick antiplatelet factors; vascular cell growth promoters such as growth factors, transcriptional activators, and translational promoters; vascular cell growth inhibitors such as growth factor inhibitors, growth factor receptor antagonists, transcriptional repressors, translational repressors, replication inhibitors, inhibitory antibodies, antibodies directed against growth factors, bifunctional molecules consisting of a growth factor and a cytotoxin, bifunctional molecules consisting of an antibody and a cytotoxin; cholesterol-lowering agents; vasodilating agents; agents which interfere with endogenous vascoactive mechanisms; inhibitors of heat shock proteins such as geldanamycin; and any combinations and prodrugs of the above.

Exemplary biomolecules include peptides, polypeptides and proteins; oligonucleotides; nucleic acids such as double or single stranded DNA (including naked and cDNA), RNA, antisense nucleic acids such as antisense DNA and RNA, small interfering RNA (siRNA), and ribozymes; genes; carbohydrates; angiogenic factors including growth factors; cell cycle inhibitors; and anti-restenosis agents. Nucleic acids may be incorporated into delivery systems such as, for example, vectors (including viral vectors), plasmids or liposomes.

Non-limiting examples of proteins include monocyte chemoattractant proteins ("MCP-1) and bone morphogenic proteins ("BMPs"), such as, for example, BMP-2, BMP-3, BMP-4, BMP-5, BMP-6(Vgr-1), BMP-7 (OP-1), BMP-8, BMP-9, BMP-10, BMP-11, BMP-12, BMP-13, BMP-14, BMP-15. Preferred BMPS are any of BMP-2, BMP-3, BMP-4, BMP-5, BMP-6, and BMP-7. These BMPs can be provided as homodimers, heterodimers, or combinations thereof, alone or together with other molecules. Alternatively, or in addition, molecules capable of inducing an upstream or downstream effect of a BMP can be provided. Such molecules include any of the "hedgehog" proteins, or the DNA's encoding them. Non-limiting examples of genes include survival genes that protect against cell death, such as anti-apoptotic Bcl-2 family factors and Akt kinase and combinations thereof. Non-limiting examples of angiogenic factors include acidic and basic fibroblast growth factors, vascular endothelial growth factor, epidermal growth factor, transforming growth factor $\alpha$ and $\beta$, platelet-derived endothelial growth factor, platelet-derived growth factor, tumor necrosis factor $\alpha$, hepatocyte growth factor, and insulin like growth factor. A non-limiting example of a cell cycle inhibitor is a cathespin D (CD) inhibitor. Non-limiting examples of anti-restenosis agents include p15, p16, p18, p19, p21, p27, p53, p57, Rb, nFkB and E2F decoys, thymidine kinase ("TK") and combinations thereof and other agents useful for interfering with cell proliferation.

Exemplary small molecules include hormones, nucleotides, amino acids, sugars, and lipids and compounds have a molecular weight of less than 100 kD.

Exemplary cells include stem cells, progenitor cells, endothelial cells, adult cardiomyocytes, and smooth muscle cells. Cells can be of human origin (autologous or allogenic) or from an animal source (xenogenic), or genetically engineered.

Any of the therapeutic agents may be combined to the extent such combination is biologically compatible.

Any of the above mentioned therapeutic agents may be incorporated into a polymeric coating on the medical device or applied onto a polymeric coating on a medical device. The polymers of the polymeric coatings may be biodegradable or non-biodegradable. Non-limiting examples of suitable non-biodegradable polymers include polyvinylpyrrolidone including cross-linked polyvinylpyrrolidone; polyvinyl alcohols, copolymers of vinyl monomers such as EVA; polyvinyl ethers; polyvinyl aromatics; polyethylene oxides; polyesters including polyethylene terephthalate; polyamides; polyacrylamides; polyethers including polyether sulfone; polyalkylenes including polypropylene, polyethylene and high molecular weight polyethylene; polyurethanes; polycarbonates, silicones; siloxane polymers; cellulosic polymers such as cellulose acetate; polymer dispersions such as polyurethane dispersions (BAYHYDROL®); squalene emulsions; and mixtures and copolymers of any of the foregoing.

Non-limiting examples of suitable biodegradable polymers include polycarboxylic acid, polyanhydrides including maleic anhydride polymers; styrene-isobutylene-styrene block copolymers such as styrene-isobutylene-styrene tert-block copolymers (SIBS); polyorthoesters; poly-amino acids; polyethylene oxide; polyphosphazenes; polylactic acid, polyglycolic acid and copolymers and mixtures thereof such as poly(L-lactic acid) (PLLA), poly(D,L,-lactide), poly (lactic acid-co-glycolic acid), 50/50 (DL-lactide-co-glycolide); polydioxanone; polypropylene fumarate; polydepsipeptides; polycaprolactone and co-polymers and mixtures thereof such as poly(D,L-lactide-co-caprolactone) and polycaprolactone co-butylacrylate; polyhydroxybutyrate valerate and blends; polycarbonates such as tyrosine-derived polycarbonates and arylates, polyiminocarbonates, and polydimethyltrimethylcarbonates; cyanoacrylate; calcium phosphates; polyglycosaminoglycans; macromolecules such as polysaccharides (including hyaluronic acid; cellulose, and hydroxypropylmethyl cellulose; gelatin; starches; dextrans; alginates and derivatives thereof), proteins and polypeptides; and mixtures and copolymers of any of the foregoing. The biodegradable polymer may also be a surface erodable polymer such as polyhydroxybutyrate and its copolymers, polycaprolactone, polyanhydrides (both crystalline and amorphous), maleic anhydride copolymers, and zinc-calcium phosphate.

In a preferred embodiment, the polymer is polyacrylic acid available as HYDROPLUS® (Boston Scientific Corporation, Natick, Mass.), and described in U.S. Pat. No. 5,091,205, the disclosure of which is incorporated by reference herein. In a more preferred embodiment, the polymer is a co-polymer of polylactic acid and polycaprolactone.

Such coatings used with the present invention may be formed by any method known to one in the art. For example, an initial polymer/solvent mixture can be formed and then the therapeutic agent added to the polymer/solvent mixture. Alternatively, the polymer, solvent, and therapeutic agent can be added simultaneously to form the mixture. The polymer/solvent mixture may be a dispersion, suspension or a solution. The therapeutic agent may also be mixed with the polymer in the absence of a solvent. The therapeutic agent may be dissolved in the polymer/solvent mixture or in the polymer to be in a true solution with the mixture or polymer, dispersed into fine or micronized particles in the mixture or polymer, suspended in the mixture or polymer based on its solubility profile, or combined with micelle-forming compounds such as surfactants or adsorbed onto small carrier particles to create a suspension in the mixture or polymer. The coating may comprise multiple polymers and/or multiple therapeutic agents.

The coating can be applied to the medical device by any known method in the art including dipping, spraying, rolling, brushing, electrostatic plating or spinning, vapor deposition, air spraying including atomized spray coating, and spray coating using an ultrasonic nozzle.

The coating is typically from about 1 to about 50 microns thick. In the case of balloon catheters, the thickness is preferably from about 1 to about 10 microns, and more preferably from about 2 to about 5 microns. Very thin polymer coatings, such as about 0.2-0.3 microns and much thicker coatings, such as more than 10 microns, are also possible. It is also within the scope of the present invention to apply multiple layers of polymer coatings onto the medical device. Such multiple layers may contain the same or different therapeutic agents and/or the same or different polymers. Methods of choosing the type, thickness and other properties of the polymer and/or therapeutic agent to create different release kinetics are well known to one in the art.

The medical device may also contain a radio-opacifying agent within its structure to facilitate viewing the medical device during insertion and at any point while the device is implanted. Non-limiting examples of radio-opacifying agents are bismuth subcarbonate, bismuth oxychloride, bismuth trioxide, barium sulfate, tungsten, and mixtures thereof.

Non-limiting examples of medical devices according to the present invention include catheters, guide wires, balloons, filters (e.g., vena cava filters), stents, stent grafts, vascular grafts, intraluminal paving systems, implants and other devices used in connection with drug-loaded polymer coatings. Such medical devices may be implanted or otherwise utilized in body lumina and organs such as the coronary vasculature, esophagus, trachea, colon, biliary tract, urinary tract, prostate, brain, lung, liver, heart, skeletal muscle, kidney, bladder, intestines, stomach, pancreas, ovary, cartilage, eye, bone, and the like.

While the present invention has been described in connection with the foregoing representative embodiment, it should be readily apparent to those of ordinary skill in the art that the representative embodiment is exemplary in nature and is not to be construed as limiting the scope of protection for the invention as set forth in the appended claims.

DRAWINGS LEGEND

100—conventional cross-wire fixture
101—end loop C frame
102—long C frame
103—collet fixture C frame
110—conventional collet
111—frame fixture fitting
112—pick and place interface
113—stem shaft
120—direction of insertion of cross-wire into collet
140—cross-wire
141—end loop of cross-wire
142—collet-side loop of cross-wire
300—integrated cross-wire fixture
310—insert molded collet section
311—cross-wire anchors
312—molded collet-fixture interface
313—molding sink relief
314—central axis side of loop anchor
315—loop crossing side of loop anchor
320—fixture main frame
500—curved integrated cross-wire fixture
510—curved main frame fixture
600—diamond assembly integrated fixture
610—diamond frame
620—stent
700—integrated tuning fork fixture
710—bent tuning fork-type wire arrangement

What is claimed is:

1. A fixture for holding a hollow, cylindrical device from an inside surface, comprising:
- a collar component having a length extending along a collar central axis;
- a main frame fixture having a proximal end, a distal end, and a length extending along a frame central axis that is coextensive with the collar central axis, wherein said main frame fixture is attached to the collar component at said proximal end; and
- a cross-wire that loops over said distal end of the main frame fixture, extends coextensive with the collar central axis and the frame central axis and loops over two tabs of the collar component.

2. The fixture of claim 1, wherein the section of the collar component is adapted to accommodate a correctly looped cross-wire at least one of in a groove of the collar component and parallel to a feature of the collar component.

3. The fixture of claim 1, wherein the section of the collar component is adapted to accommodate the incorrectly looped cross-wire at least one of across a groove of the collar component and across a feature of the collar component.

4. The fixture of claim 1, further comprising a trigger-activated tensioner adapted to tension the cross-wire on the main frame fixture.

5. The fixture of claim 1, wherein the main frame fixture comprises a symmetric design.

6. The fixture of claim 5, wherein the symmetric design comprises two oval halves.

7. The fixture of claim 5, wherein the symmetric design comprises two rectangular halves.

8. The fixture of claim 1, wherein the collar component comprises:
- a pick-and-place interface; and
- a stem shaft.

9. The fixture of claim 8, wherein the pick-and-place interface comprises a molding sink relief adapted to be manipulated by a robotic arm.

10. The fixture of claim 8, wherein the pick-and-place interface comprises a stem shaft adapted to be received in an automated receptacle, the automated receptacle adapted to move the fixture.

11. The fixture of claim 1, wherein the collar component comprises a radio frequency identification tag.

12. The fixture of claim 1, wherein the fixture is adapted to hold a stent during a coating operation.

13. The fixture of claim 1, wherein the collar component is stiff.

14. The fixture of claim 1, wherein the fixture is adapted for insertion into a vertical alignment system.

15. The fixture of claim 1, wherein the collar component has a stem shaft which is insertable into a vertical alignment system.

16. The fixture of claim 1, wherein the main frame fixture is fixedly secured within the collar component.

17. A fixture for holding a hollow, cylindrical device from an inside surface, comprising:
- a collar component having a length extending along a collar central axis;
- a main frame fixture having a proximal end, a distal end, and a length extending along a frame central axis that is coextensive with the collar central axis, wherein said main frame fixture is attached to the collar component at said proximal end; and a cross-wire that loops over said distal end of the main frame fixture, extends coextensive with the collar central axis and the frame central axis, and ioops over a section of the collar component, and a trigger-activated tensioner adapted to tension the cross-wire on the main frame fixture.

18. A fixture for holding a hollow, cylindrical device from an inside surface, comprising:

a collar component having a length extending along a collar central axis;

a symmetric main frame fixture having a proximal end, a distal end, and a length extending along a frame central axis that is coextensive with the collar central axis, wherein said main frame fixture is attached to the collar component at said proximal end; and a cross-wire that loops over said distal end of the main frame fixture, extends coextensive with the collar central axis and the frame central axis, and loops over a section of the collar component.

19. The fixture of claim 18, wherein the symmetric main frame fixture comprises two oval halves.

20. The fixture of claim 18, wherein the symmetric main frame fixture comprises two rectangular halves.

* * * * *